United States Patent [19]

Horne

[11] 3,959,841

[45] June 1, 1976

[54] APPARATUS FOR APPLYING LIQUID PREPARATIONS TO THE BODY

[76] Inventor: Juliana S. Horne, c/o Hoopes - 24 Aragon Ave., Latham, N.Y. 12110

[22] Filed: June 23, 1975

[21] Appl. No.: 589,198

[52] U.S. Cl. ..... 15/104.94; 15/222; 128/67; 401/8

[51] Int. Cl.[2] ..... A47K 7/03

[58] Field of Search ..... 15/222, 104.94; 401/7, 401/8; 128/67

[56] References Cited

UNITED STATES PATENTS

| | | | |
|---|---|---|---|
| 2,730,745 | 1/1956 | Norman | 15/222 X |
| 3,674,374 | 7/1972 | Jennings | 401/8 |
| D126,875 | 4/1941 | Steichen | 15/222 UX |

*Primary Examiner*—Edward L. Roberts
*Attorney, Agent, or Firm*—Fred Fisher

[57] ABSTRACT

Apparatus for use by a person for applying liquid preparations, such as lotions, creams, and the like, across portions of the body of such person is disclosed. The apparatus includes an integral elongated reticulated fabric folded along its major axis to form a body of double thickness so that one edge of the fabric along its length is characterized by the fold, and the opposite edge is characterized by overlapped bare terminations. The fabric has two spaced lines of transverse stitching centrally located so as to form a pocket. The fabric has longitudinal stitching along the bare terminations extending outwardly from the pocket. Loops are formed on opposite ends of the fabric by transverse stitching of folded-over ends of the fabric. A disposable pad, such as paper, is adapted to be inserted into the pocket.

8 Claims, 3 Drawing Figures

APPARATUS FOR APPLYING LIQUID PREPARATIONS TO THE BODY

BACKGROUND OF THE INVENTION

1. Field of the Invention

This invention relates to apparatus for use by a person for applying liquid preparations, such as lotions, creams, medications, ointments, and the like across various portions of the body, and, in particular, to hard-to-reach sections of the body, such as the back. Accordingly, it is a general object of the invention to provide new and improved apparatus of such character.

2. Description of the Prior Art

Various prior art patents are directed to devices for massaging one's back, or to devices primarily for applying soap to one's back. Various patents include devices with hand loops at the ends. Some patents have a holder about midway between the loops. However, the devices set forth in the prior art patents, of which applicant is aware, suffer from one or more disadvantages. They are non-washable, have separate handles, are used exclusively for applying soap and not lotions or creams, are complicated and/or are expensive to manufacture.

SUMMARY OF THE INVENTION

It is a principal object of this invention to provide new and improved apparatus for applying liquid preparations to a person's body, wherein such apparatus is simple in construction and inexpensive to manufacture.

Another object of this invention is to provide new and improved apparatus for applying liquid preparations to a person's body, wherein such apparatus consists of two inexpensive components: one which is washable, and the other of which is disposable.

Yet another object of the invention is to provide new and improved apparatus for applying liquid medications, such as lotions and creams, to a user's body.

In accordance with one embodiment of the invention, apparatus for use by a person for applying liquid preparations, such as lotions, creams, and the like, across portions of the person's body includes two components. One component is an integral elongated reticulated fabric folded along its major axis to form a body of double thickness so that one edge of the fabric along its length is characterized by the fold, and the opposite edge is characterized by overlapped bare terminations. The fabric has two spaced lines of transverse stitching centrally located so as to form a pocket. The fabric has longitudinal stitching along the bare terminations extending outwardly from the pocket. Loops are formed on opposite ends of the fabric by transverse stitching of folded-over ends of the fabric. The other component is a disposable pad which is adapted to be inserted into the pocket. In accordance with certain features of the invention, the fabric can be maline, tulle, or otherwise washable. In accordance with other features of the invention, the pad can be paper, cellulose layer, or paper affixed to a water impervious base exterior to one side or interior to the pad.

BRIEF DESCRIPTION OF THE DRAWINGS

Other objects, advantages, and features of this invention will become more apparent from a reading of the specification, when read in conjunction with the accompanying drawing, in which.

DESCRIPTION OF THE INVENTION

Figure 1:
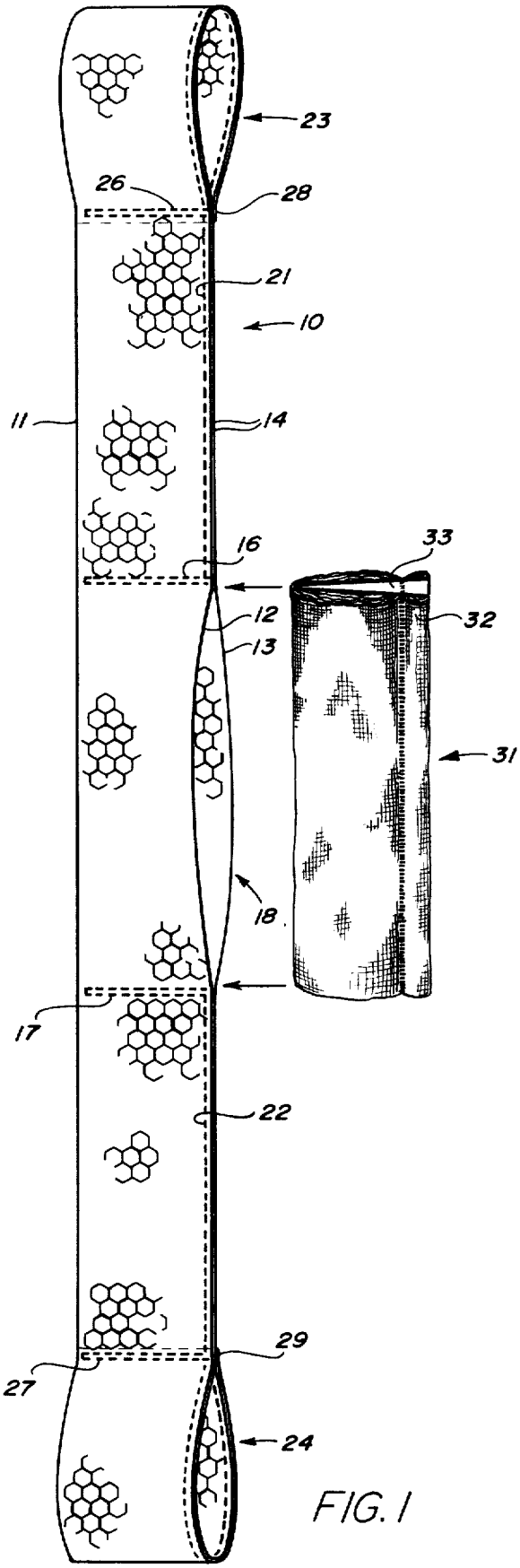
FIG. 1 is a partially exploded view of one embodiment of this invention, depicting an integral reticulated fabric having a pocket formed therein, and a folded disposable pad for insertion into the pocket.
Figure 2:
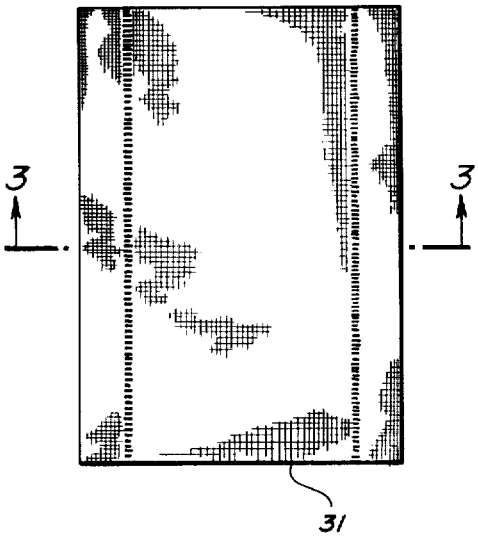
FIG. 2 is a plan view of the pad shown in FIG. 2, depicted in an unfolded condition.

Referring to FIG. 1, there is shown an integral elongated reticulated fabric 10 folded at 11 along its major axis to form a body of double thickness 12, 13. Thus one edge of the fabric 10 is characterized by the fold 11, and the opposite edge is characterized by overlapped bare terminations 14—14.

The fabric 10 is preferably maline, although tulle is acceptable. Ordinary netting can be quite coarse and irritating to many skins.

The fabric 10 has two spaced lines of transverse stitching 16, 17 centrally located so as to form a pocket 18 having a single thickness of fabric.

The fabric 10 has longitudinal stitching 21, 22 along the bare terminations 14—14 extending outwardly from the pocket 18.

Loops 23, 23 are formed on opposite ends of the fabric by transverse stitching 26, 27 of folded-over ends 28, 29, respectively, of the fabric 10.

Figure 3:
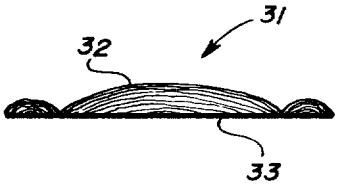
FIG. 3 is a sectional view of the pad taken along the line 3—3 of FIG. 2.

A disposable pad is adapted to be inserted into the pocket 18. The pad can be paper or cellulose layer which may be affixed to a water impervious base exterior to one side or interior to the pad. In a preferred embodiment, shown in the drawings, the pad 31 can comprise paper 32 affixed to a water impervious base 33 (see FIG. 3), and folded singly so that the base 33 is interior to the pad 31 (FIG. 1).

OPERATION

The disposable pad 31 is inserted into the pocket 18 of the integral elongated reticulated fabric. Medication, ointment, lotion, or the like is applied to the exterior of the pocket 18, and the apparatus is ready for use. The individual can apply the medication, lotion, etc., to one's own back (or other part of the body) by putting one's hands into the loops 23, 23 and traversing the pocket coated medication, lotion, etc. across the desired area of the body.

IN GENERAL

The pad 31 absorbs most skin preparations whereby the fabric, preferably maline, is left with almost no residue.

Preferably, the pad 31 is designed to be small in size, and thin so as to avoid waste of the skin preparation.

The pad 31 does not require the use of an expensive filler, since the maline covering assures a smooth surface for contact with the skin.

Overall, the maline fabric holder is highly useful, providing the functions of holding the disposable pad, and providing a smooth surface to the skin. The holder is inexpensive to manufacture so as to provide for general use to protect and care for the skin.

Dry skin requires lotions, or other medication, to ease itching and scaling that accompanies dry skin. Protection from the sun, by application of suitable sun screens, call for applications to hard-to-reach areas of the body. Similarly, sun tan oils and creams, sun-burn oils and creams require application to hard to reach areas of the body.

Arthritics, with limited use of movement of their body, can care for themselves and ease pain with heat comforting liniments. Without a helping attendant, one can not conveniently care for or treat the areas of the back without apparatus of the type specified herein.

This invention does not wash, invigorate, or massage the body. On the contrary, this invention provides for a smooth, comfortable application of lotions, creams, medications, drugs, skin care preparations, and the like to the body, without irritating the skin, by oneself who is alone or not in a position to be aided by another.

The invention comprises two components: The fabric holder is washable and re-usable. The pad 31, after use, can be easily removed from the pocket 18 and discarded.

An essential feature of the invention is that the two components are required; the elongated reticulated fabric, without the pad, is not feasible for use in applying a wide range of preparations.

Various modifications can be performed without departing from the spirit and scope of the invention, as for example, the holder may have four layers in lieu of two. Other examples will suggest themselves to those skilled in the art, without departing from the spirit and scope of the appended claims.

What is claimed is:

1. Apparatus for use by a person for applying liquid preparations, such as lotions, creams, and the like, across portions of the body of said person, comprising an integral elongated reticulated fabric folded along its major axis to form a body of double thickness so that one edge of said elongated fabric along its length is characterized by such fold and the opposite edge of said fabric along its length is characterized by overlapped bare terminations, said fabric having two spaced lines of transverse stitching centrally located so as to form a pocket therewithin, said fabric having longitudinal stitching along said bare terminations extending outwardly from said pocket, and loops formed on opposite ends of said elongated fabric by transverse stitching of folded-over ends of said fabric; and a disposable pad adapted to be inserted into said pocket.

2. Apparatus as recited in claim 1 wherein said fabric is maline.

3. Apparatus as recited in claim 1 wherein said fabric is tulle.

4. Apparatus as recited in claim 1 wherein said fabric is washable.

5. Apparatus as recited in claim 1 wherein said pad comprises paper.

6. Apparatus as recited in claim 1 wherein said pad comprises paper affixed to a water impervious base and folded singly so that said base is interior to said pad.

7. Apparatus as recited in claim 2 wherein said pad comprises paper.

8. Apparatus as recited in claim 2 wherein said pad comprises paper affixed to a water impervious base and folded singly so that said base is interior to said pad.

* * * * *